United States Patent [19]

Brunswick

[11] Patent Number: 4,519,184

[45] Date of Patent: May 28, 1985

[54] LIQUID FILLING APPARATUS

[75] Inventor: Robert Brunswick, Clayton, Australia

[73] Assignee: Wrightcel Limited, Victoria, Australia

[21] Appl. No.: 338,483

[22] Filed: Jan. 11, 1982

[30] Foreign Application Priority Data

Jan. 13, 1981 [AU] Australia ..... PE7222
Jan. 16, 1981 [AU] Australia ..... PE7227

[51] Int. Cl.[3] ..... B65B 31/06; B65B 1/48

[52] U.S. Cl. ..... 53/503; 53/268; 53/512

[58] Field of Search ..... 53/434, 268, 512, 503, 53/88, 266 R; 156/217, 252; 141/10, 61, 114

[56] References Cited

U.S. PATENT DOCUMENTS 3,245,200 4/1966 Shaw ..... 53/512
3,578,038 5/1971 Burford ..... 141/114 X
3,824,762 7/1974 Walles ..... 53/88
4,120,134 10/1978 Scwolle ..... 53/268
4,283,901 8/1981 Schiese et al. ..... 53/503 X
4,360,996 11/1982 Rutter ..... 53/469

FOREIGN PATENT DOCUMENTS 2919388 11/1979 Fed. Rep. of Germany .

*Primary Examiner*—John Sipos
*Assistant Examiner*—Donald Studebaker
*Attorney, Agent, or Firm*—Memel, Jacobs, Pierno, Gersh & Ellsworth

[57] ABSTRACT

A filling station for filling flexible containers with liquid. The filling head is fixed. The container is gripped and brought into abutment with the filling head outlet. The container is filled and subsequently while the container is still in abutment with the filling head it is heat sealed. The container is then removed.

6 Claims, 9 Drawing Figures

LIQUID FILLING APPARATUS

This invention relates to a method and apparatus of filling flexible containers particularly flexible containers for storing and dispensing liquids.

Generally apparatus for filling flexible containers incorporate a moveable filling head that moves vertically to align with the opening of the flexible container and to withdraw at the completion of the filling operation. The filling head incorporates a flow meter for measuring the quantity of fluid to be dispensed and because it is moveable, the filling head is connected to the pump by flexible conduits. Usually these flexible conduits are of synthetic plastic which are not conducive to steam cleaning. Thus the filling heads in contemporary use are not able to be used in an aseptic filling method where sterility of the liquid contents can be guaranteed.

Another problem associated with the storage of many liquid products is the necessity to maintain an absence of air from the container. Although flexible containers are appropriate for anaerobic storage conventional filling techniques cannot avoid the inclusion of some air into the container. In particular when the filling head withdraws from the filled container the head space occupied by the filling nozzle is replaced by air. After withdrawal of the filling head the container is sealed and this air in the head space is trapped within the flexible container.

It is an object of the present invention to provide a method and apparatus for the aseptic and anaerobic filling of flexible containers with liquids.

To this end the present invention provides apparatus for filling flexible containers comprising a fixed filling head with means for dispensing liquid therefrom, holding means for supporting a flexible container and aligning it with a filling head, abutment means associated with said holding means for moving said flexible container so that its opening abuts the filling head and sealing means for sealing said container while it is in abutment with said filling head.

By using a fixed filling head and permanently sealing the container while it is still in abutment with the filling head no air can enter the head space occupied by the filling nozzle. The container is sealed immediately adjacent the filling nozzle, and consequently it is possible to achieve anaerobic filling of the container. Another advantage of this arrangement is that by using a fixed filling head fixed conduits can be used. Thus stainless steel filling lines capable of being steam cleaned can be used and this ensures that an aseptic filling system can be guaranteed.

Generally the flow meters attached to filling heads as conventionally used are of lower accuracy than the best available flow meters in order to save costs. Because flexible conduits between the outlet nozzle and the flow meter renders accurate measurement impossible it is essential to locate the flow meter on the filling head.

It is a further object of the present invention to provide a method and apparatus for the accurate aseptic filling of flexible containers with liquids.

To this end the present invention also provides apparatus for filling flexible containers with liquid comprising in combination one or more holding means for holding flexible containers for filling, a fixed position filling head associated with each of said holding means, a flow meter for measuring liquid volumes to be dispensed to said one or more filling heads, means for maintaining liquid pressure in the apparatus and rigid conduits, capable to being steam cleaned under pressure, connecting said means for maintaining liquid pressure with said flow meter and said filling heads. Preferably the apparatus also includes means for monitoring volumes passing through said flow meter and, means for actuating valves in said filling heads to open and close said valves in response to volume flows monitored on said flow meter.

Another means of monitoring the quantity of liquid dispensed from a filling head is to use a metering device that also takes into account the period between the opening and closing of the fluid outlet valve in each filling head. In this embodiment one metering device is used for each filling head. Whether a single metering device is used for each filling head or for several filling heads will depend on the type of liquid being handled the degree of accuracy required in filling the containers.

The method of filling flexible containers according to this invention comprises, holding a flexible container, moving it into alignment with a fixed filling head, filling the container with liquid, sealing the flexible container and withdrawing the sealed and filled flexible container.

Both the apparatus and method of the present invention may include the optional requirement of evacuating the flexible container prior to filling. However it is possible to use an evacuated bag that requires no evacuation during the filling and sealing procedure.

It is preferred that the flexible containers as described in Australian patent No. 519,675 be used in the method of the present invention. That specification describes a flexible container sealed about its edges and carrying in one wall a collar formed about a hole in said one wall said collar being capable of accommodating dispensing means; said flexible container further having an internal flap in juxtaposition with said collar means, said flap comprising a first heat-sealable surface and a second non-heat-sealable surface, the first and second surfaces facing towards and away from the dispensing means, respectively.

A preferred embodiment of this invention will now be described with reference to the drawings.

Figure 1:
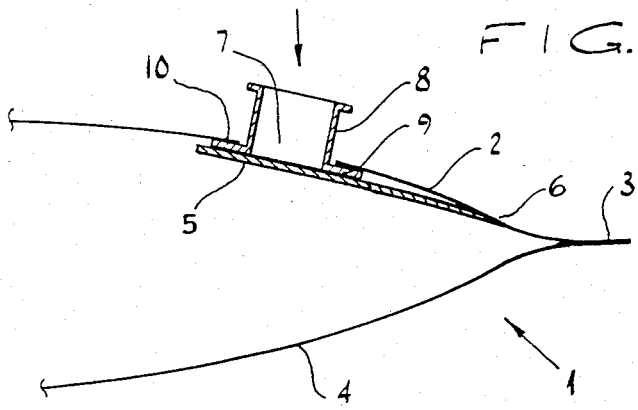
FIG. 1 illustrates a part of a flexible bag in accordance with the invention, during the course of filling.

Referring to FIG. 1, the bag—generally designated as 1—comprises a wall 2 heat sealed at the periphery 3 to a lower wall 4. An internal flap 5 has its fixed end 6 (heat sealed) to the wall 2. The flap 5 extends across and beyond an opening 7 in the flexible container wall 2 into which fits a collar 8. The flange 9 of collar 8 is heat sealed to the periphery 10 of the opening. The flap 5 does not impede filling of the bag. As mentioned above the collar 8 can easily be secured to wall 2 by suitable machinery.

The flap 5 need not be secured to the side 2 as shown but may conveniently be bonded to one face of the collar 8.

Figure 2:
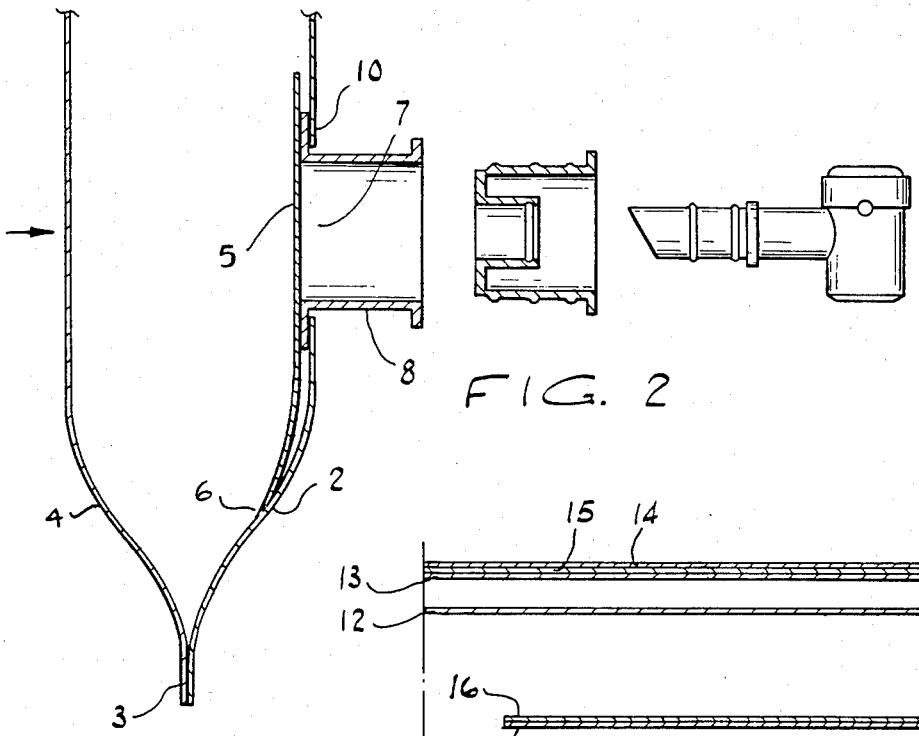
FIG. 2 illustrates the same part, after filling, and sealing of the flap in association with a dispensing tap.

Once the bag is full, a hot press (not shown) is brought to bear on the bag in the direction shown by the arrow in FIG. 2 with the result that the flap becomes sealed to the wall 2 and the collar 8 but not the wall 4 of the container.

In FIG. 2 in exploded view is shown the tap construction comprising a tap socket which can be snugly fitted into socket 8 and a tap which includes a piercing pipe that ruptures the flap covering opening 7 when it is secured within the socket which in turn is secured in collar 8.

Figure 3:
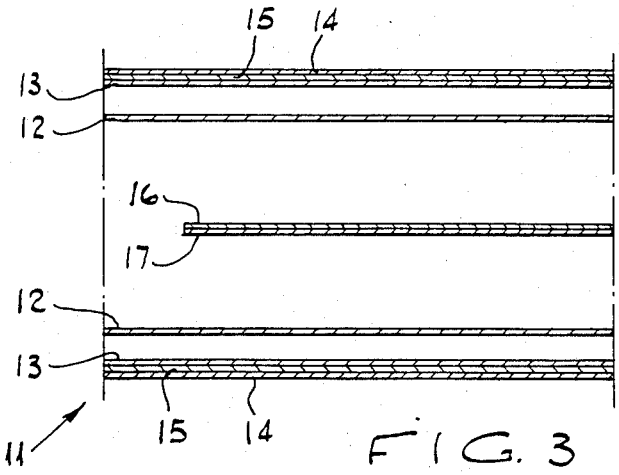
FIG. 3 illustrates, in enlarged form, the various walls and flap constructions of the flexible bag shown in FIG. 1.

As shown in FIG. 3, each wall 2 and 4 comprises an outer laminate 11 and an inner but separate layer of polyethylene 12. In one preferred embodiment the laminate 11 has an inner layer 13 of polyethylene, an outer layer 14 of nylon and an intermediate layer 15 of Saran (Registered Trade Mark). The flap, on the other hand, also in laminate form has a polyethylene layer 16 and a non-heat-sealable layer 17. The flap may also incorporate a gas barrier layer. It is not essential to this invention that the walls of the container be in laminate form but this is simply a preferred requirement.

This container construction is used with the apparatus of this invention.

Figure 4:
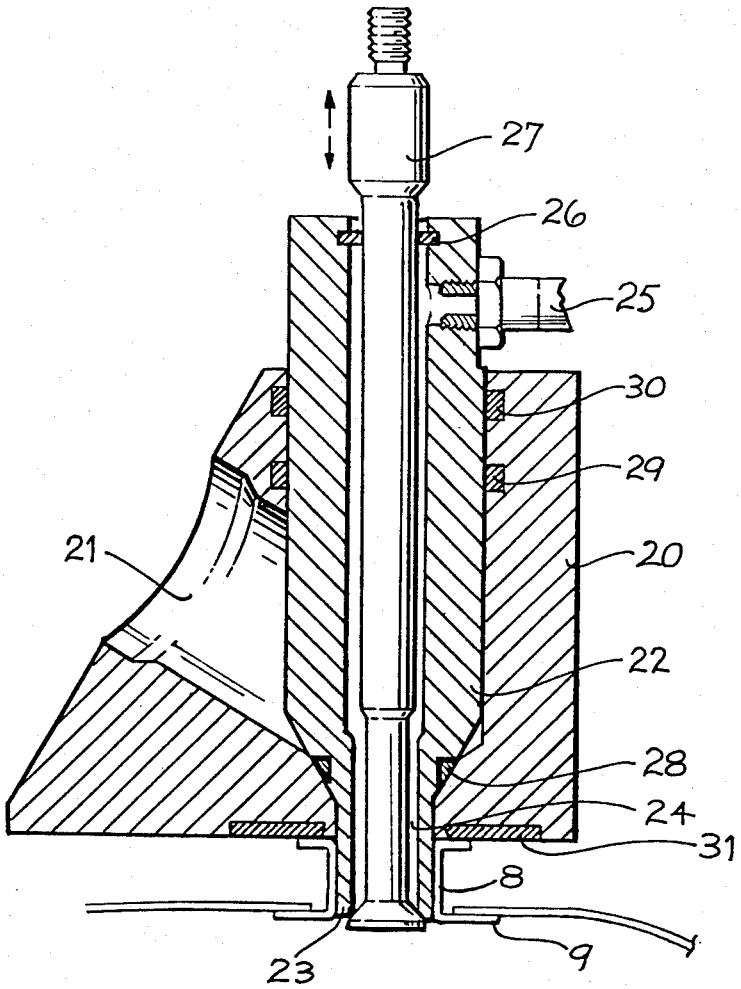
Figure 5:
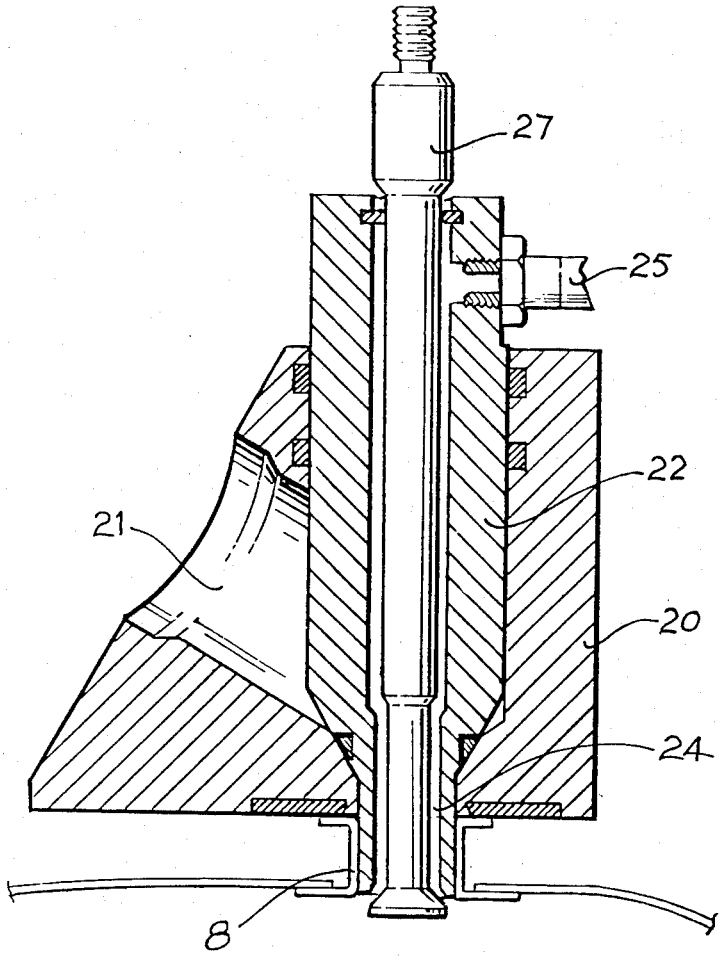
Figure 6:
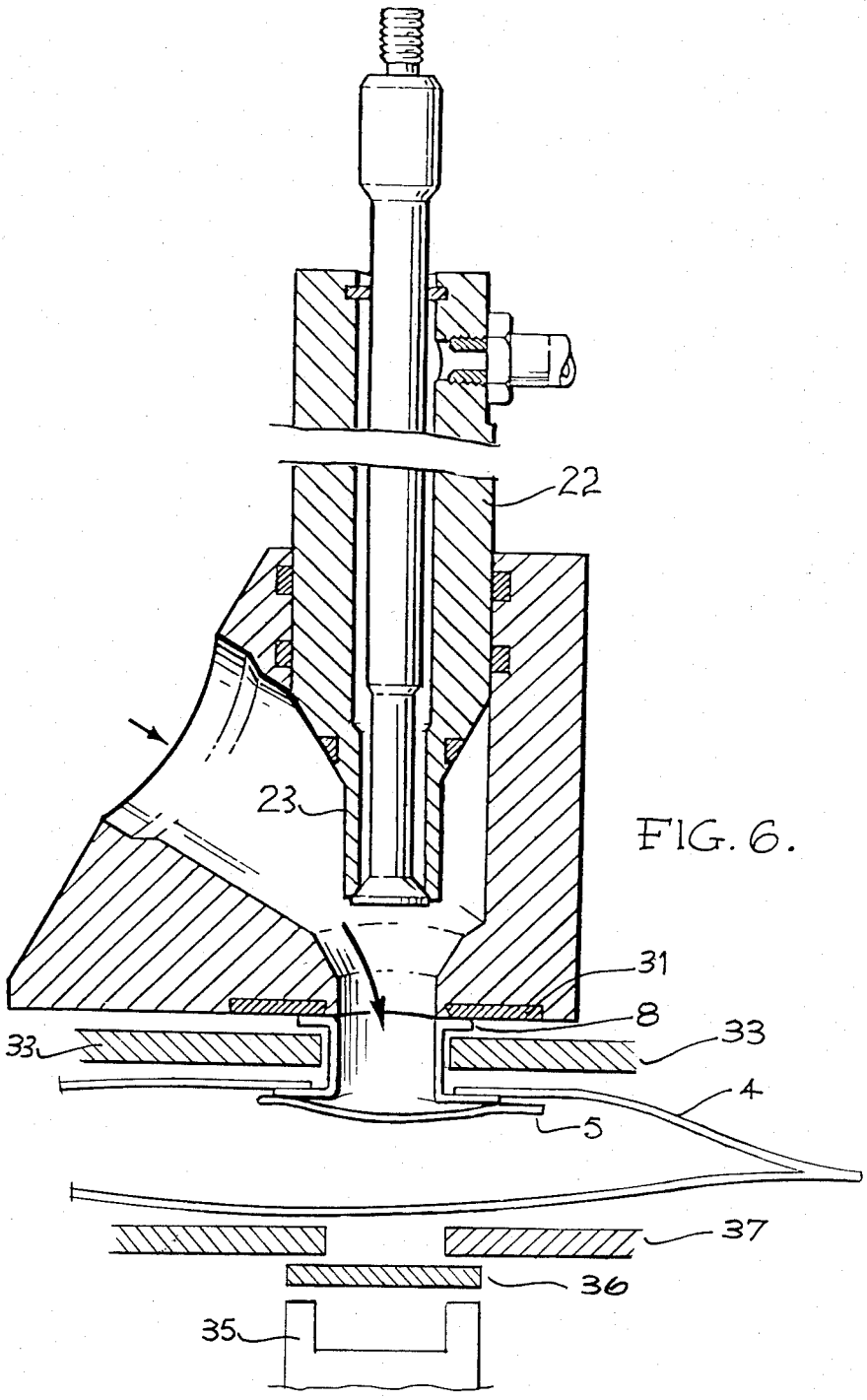
Figure 7:
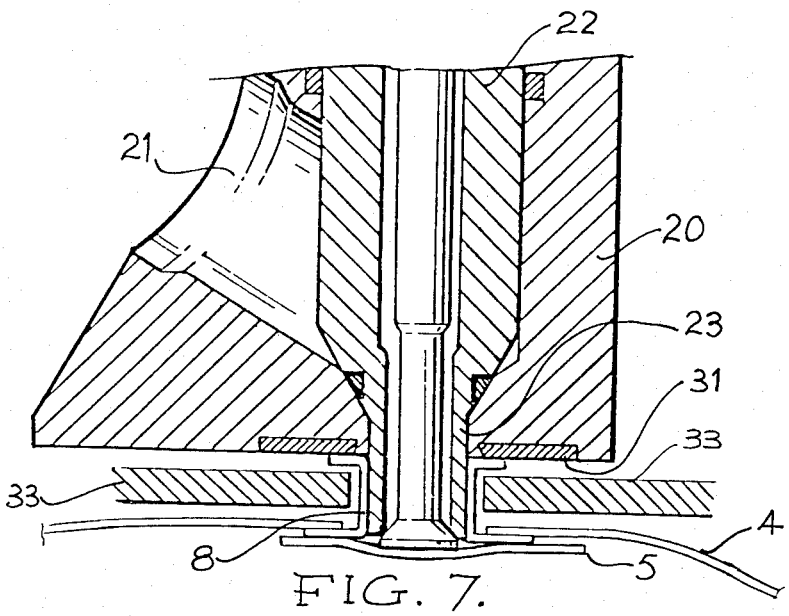
Figure 8:
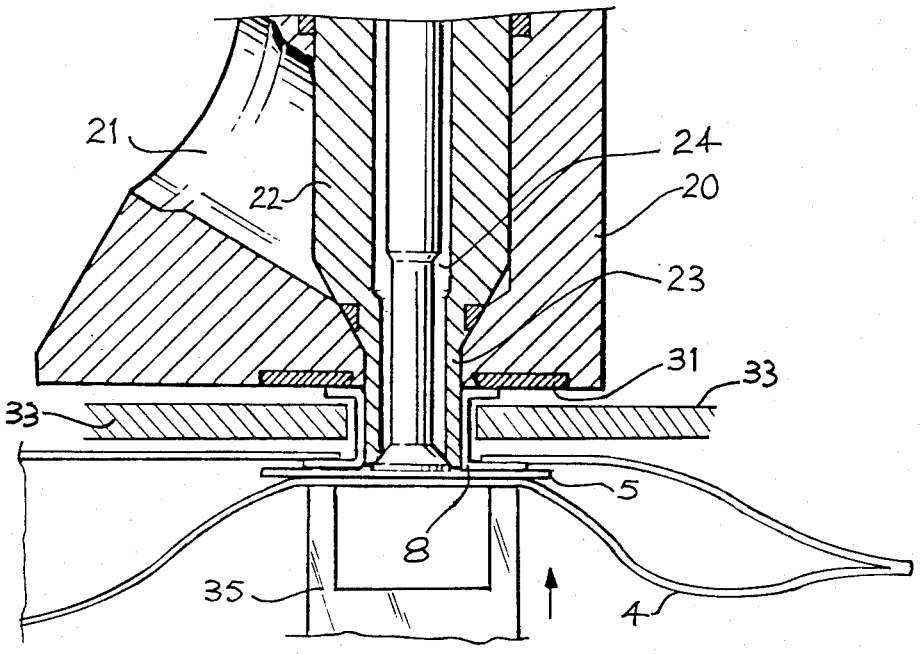
Figure 9:
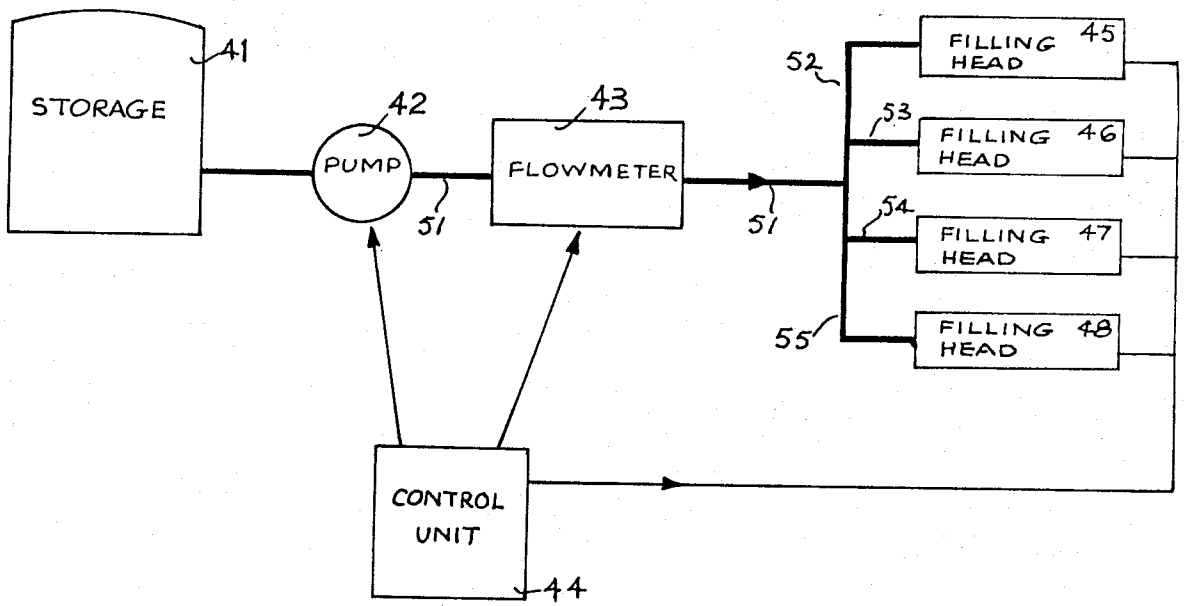

FIG. 4 illustrates a cross-sectional view of the filling head; FIG. 5 illustrates a cross-sectional view of the filling head during the evacuation cycle;

FIG. 6 illustrates a cross-sectional view of the head during the filling cycle; FIG. 7 is a cross-sectional view similar to FIG. 4 but showing the manner in which the flexible container is secured to the filling head; FIG. 8 illustrates the sealing operation while the container is still in position at the filling head; FIG. 9 illustrates schematically one embodiment of the control means for multiple filling heads.

The filling head comprises a general body section 20 which includes a liquid inlet channel 21 closed by the valve member 22. This valve member extends within the body section 20 and extends beyond it to form the head space shaft 23 which seats within the collar 8 of the flexible container. Valve member 22 includes evacuation port 24 which is connected to a vacuum line 25. The vacuum port 24 is closed by the seal 26 and the valve stem 27 which reciprocates within the valve member 22.

When the valve member 22 is in its closed position the liquid outlet channel 21 is sealed and the seals 28, 29 and 30 ensure that no liquid can escape once the valve member 22 is closed.

As shown in FIGS. 4, 6 and 7 the collar 8 abuts against the peripheral seal 31 of body section 20 to provide an airtight as well a liquid tight seal between the flexible container and the filling head.

In FIG. 6 the complete flexible container is illustrated being held against the body section 20 by clamps 33. These clamps 33 grip the collar 8 and a trapdoor 36 supports the flexible container but provides a sufficient gap to enable liquid to flow through collar 8 past flap 5 and into the body of the flexible container 1. The support of trapdoor 36 is required to ensure the pressure of the liquid during the filling.

The sequence of operations is that initially a flexible container 1, is taken by clamps 33 and lifted into alignment with the filling head such that collar 8 fits over the shaft 23 and abuts tightly against the seal 31 on the body section 20.

If the flexible container requires evacuation the valve stem 27 moves to open the evacuation port 24. After completion of the evacuation step valve 27 closes the port 24 and valve member 22 rises to open the liquid inlet 21 to enable filling of the flexible container to occur. Upon the completion of filling the valve member closes inlet 21 and the shaft 23 re-enters collar 8. This ensures that all liquid in the collar 8 is displaced into the flexible container and that no air is included in the container. At this point the trapdoor 36 is withdrawn and the heat sealing member 35 is brought into contact with the flexible container and results in the welding of flap 5 to the flange 9 of the collar 8 to seal the flexible container. Subsequent to sealing the filled flexible container is withdrawn from the filling head and if desired the tap can be inserted into collar 8.

Conventional pneumatics can be used to operate the movements of the various valves 22 and 27 and the clamps 33, the trapdoor 36 and sealing member 35. The timing and control of these components is similarly capable of being carried out by conventional control circuitry.

The filling apparatus as illustrated in FIG. 9 includes a liquid storage tank 41, a pump 42, a flow meter 43 and filling stations 45, 46, 47 and 48. These filling stations comprise a filling head and flexible container handling and sealing equipment as disclosed in Australian patent No. 519,675. The conduits 52, 53, 54 and 55 connect the filling stations to the main outlet conduit from the flow meter 43.

Each filling station incorporates a sensor for determining the presence of an unfilled container mounted for filling on the filling head. These sensors are each connected to a control unit 44, which incorporates a micro processor. The control unit 44 is in turn connected to the pump 42 and the flow meter 43. By programming the control unit the filling apparatus is able to operate on a priority basis to fill in turn each flexible container at any one filling station as it becomes available for filling. If any filling station is inoperable the system is still able to function the remaining filling stations.

By utilizing high fill speeds with an adequate pump and by using a high accuracy flow meter, a high rate of production of filled containers is possible. Because the conduits 51, 52, 53, 54 and 55 are of stainless steel complete sterilization of the filling apparatus can be assured.

This means that the apparatus of the present invention can be used for any aseptic filling of liquids. Liquids particularly adapted for this use are wine and fruit juices.

Further corrosive or poisonous chemicals can be handled by the present system because fixed conduits and filling head enable stainless steel or other inert materials to be used.

From the above it can be seen that the present invention provides an aseptic filling apparatus of improved accuracy and capacity for filling flexible containers.

I claim:

1. Apparatus for filling flexible containers with a liquid, said flexible containers having collar means affixed to one wall of said flexible container, said collar having an opening for filling said container and a flap means for closing said opening, comprising:

a fixed filling head, with a peripheral seal means located at the bottom of said filling head;

holding means for gripping said collar of said flexible container and positioning said collar against said peripheral seal means to provide a seal;

support means below said filling head on which said flexible containter is borne, said support means including a port in said support surface having means to both support the flexible container during the filling operation and to provide access for a heat sealing member to be brought into contact with said flexible container, and a heat sealing member being located below said support member to seal fluid tight by heat, the flap over the opening in said collar means.

2. Apparatus as claimed in claim 1 wherein the conduits connecting said filling head to a pump, and liquid storage tank are fixed and steam cleanable.

3. Apparatus as claimed in claim 1 wherein the filling head incorporates means for evacuating said flexible container.

4. Apparatus as claimed in claim 1 for filling flexible containers with the liquid comprising: several filling heads, each of said filling heads being associated with a holding means; a flow meter for measuring liquid volumes to be dispensed to said filling heads; means for maintaining liquid pressure in the apparatus; and, rigid conduits capable of being steam cleaned under pressure, and connecting said means for maintaining liquid pressure with said flow meter and said filling heads.

5. Apparatus as claimed in claim 4 which also includes means for monitoring volumes passing through said flow meter and means for actuating valves in said filling heads to open and close said valves in response to volume flows monitored in said flow meter.

6. Apparatus as claimed in claim 5 wherein there are four filling heads and the sequence and timing of the steps of inserting a container in the holding means, filling the container, sealing the container and removing the container are such that the liquid flow rates for filling the containers are high enough so that only one flow meter is needed for four filling heads.

* * * * *